US005911601A

United States Patent [19]

Weingartner

[11] Patent Number: 5,911,601

[45] Date of Patent: Jun. 15, 1999

[54] JACK PLUG

[75] Inventor: Bernhard Weingartner, Feldkirch, Austria

[73] Assignee: Neutrik Aktiengesellschaft, Schaan, Liechtenstein

[21] Appl. No.: 09/046,864

[22] Filed: Mar. 24, 1998

[30] Foreign Application Priority Data

Mar. 27, 1997 [DE] Germany ..... 197 12 915

[51] Int. Cl.[6] ..... H01R 13/502

[52] U.S. Cl. ..... 439/669

[58] Field of Search ..... 439/669, 668

[56] References Cited

U.S. PATENT DOCUMENTS

| | | | |
|---|---|---|---|
| 2,610,223 | 9/1952 | Puerner | 439/669 |
| 2,878,459 | 3/1959 | Barker . | |
| 3,145,329 | 8/1964 | Deakin et al. | 439/669 |

FOREIGN PATENT DOCUMENTS 44 14 012 6/1995 Germany .

*Primary Examiner*—Gary Paumen
*Assistant Examiner*—Antoine Ngandjui
*Attorney, Agent, or Firm*—McAulay Nissen Golderg Kiel & Hand, LLP

[57] ABSTRACT

A jack plug has a contact tip provided at the free end and followed by a connection part which is received by a tubular shaft of the jack plug. The contact tip with the connection part is electrically insulated from the shaft. At the side remote of the contact tip, the shaft has a handle part through which the connecting cable runs. The connection part which is formed in one piece with the contact tip has a bore hole which penetrates it over its entire length and which extends into the interior of the contact tip. The conductor of the cable to be connected can be secured in the interior of the contact tip by a material engagement or a positive engagement (crimping). The portion of the bore hole located in the contact tip is filled wit a solder and, if required, with flux. A zone of the handle part is grooved or knurled on its inner side. This zone is narrowed in diameter by radial squeezing (crimping) after the cable to be connected is inserted.

10 Claims, 4 Drawing Sheets

JACK PLUG

BACKGROUND OF THE INVENTION a) Field of the Invention

The invention is directed to a jack plug with a contact tip which is provided at the free end and followed by a connection part which is received by a tubular shaft of the jack plug, wherein the contact tip is electrically insulated from the shaft and the shaft has, at the side remote of the contact tip, a handle part through which the connecting cable runs.

b) Description of the Related Art

Jack plugs of this type are known in many constructional forms. All of them share the common feature that they have a shaft with an onion-shaped contact or contact tip provided at one end of the shaft and a handle part at the other end of the shaft. In every case, the contact tip has a contact needle which is received by the shaft and is electrically insulated therefrom. The center conductor of the connecting cable is fixed at this contact needle so as to be connected therewith in an electrically conducting manner. For this purpose, a bore hole of short length is provided in the contact needle at the handle end, wherein the conductor to be connected is inserted into this bore hole. The conductor can be connected with this bore hole in an engagement through the agency of material or by deformation. Further, it is known to squeeze in the conductor between the inner end of the contact needle and the insulating sleeve enclosing the contact needle. Further, it is already known to arrange a clamping screw at the inner end of the contact needle, wherein the center conductor mentioned above can be connected by means of this clamping screw. Examples for all of these constructions are shown in the following published materials. AT-PS 2 935; AT-PS 6 395; AT-PS 22 389; AT-PS 43 309; AT-PS 115 980; DE-PS 561 322; DE 38 34 172 A1; DE 42 27 921 A1; DE 44 14 012 C1; U.S. Pat. No. 3,656,089; U.S. Pat. No. 4,018,501; U.S. Pat. No. 4,275,946; U.S. Pat. No. 4,275,947; U.S. Pat. No. 4,335,930; U.S. Pat. No. 4,647,135; U.S. Pat. No. 2,878,459.

Two-pole connector plugs of the kind mentioned above, known as jack plugs or, in English, phone plugs, originate from telephone technology and at present are used chiefly in music electronics and electroacoustics as economical and robust plugs in unbalanced circuits, as they are called, e.g., electric guitars, instruments, sound pickups or electronic musical instruments such as synthesizers and keyboards. The accompanying cable is usually coaxial with an inner conductor of stranded wire, a rather sturdy low-impedance insulation, preferably made from polyethylene, an outer conductor arranged over this insulation in the form of a shielding braid or a shielding spiral (braided shielding or spiral shielding) covered by a plastic jacket for protecting the cable.

OBJECT AND SUMMARY OF THE INVENTION

A primary object of the invention is to provide a way for these types of plugs, many millions of which are manufactured every year and in which even minor reductions in cost therefore have great economic significance, to be manufactured more economically and also connected (fastened) substantially more quickly. A further object of the invention is to achieve a substantial reduction in parts and a drastically simplified assembly.

In accordance with the invention, a jack plug has a contact tip provided at the free end and followed by a connection part which is received by a tubular shaft of the jack plug. The contact tip with the connection part is electrically insulated from the shaft. At the side remote of the contact tip, the shaft has a handle part through which the connecting cable runs. The connection part which is formed in one piece with the contact tip has a bore hole which penetrates it over its entire length and which extends into the interior of the contact tip. The conductor of the cable to be connected can be secured in the interior of the contact tip by a material engagement or a positive engagement (crimping). The portion of the bore hole located in the contact tip is filled with a solder and, if required, with flux. A zone of the handle part is grooved or knurled on its inner side. This zone is narrowed in diameter by radial squeezing (crimping) after the cable to be connected is inserted An embodiment example of the invention is explained more fully with reference to the drawing, without the invention being limited to the embodiment example shown therein.

DESCRIPTION OF THE PREFERRED EMBODIMENTS

The drawings show the jack plug and its parts in a substantially larger scale compared with the actual construction.

Figure 5:
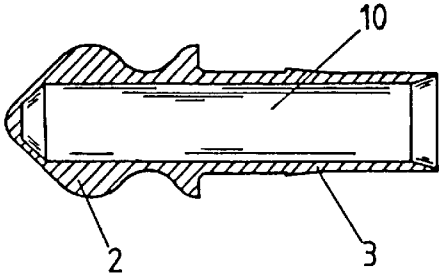
FIG 5. shows a longitudinal section through the contact tip.
Figure 6:
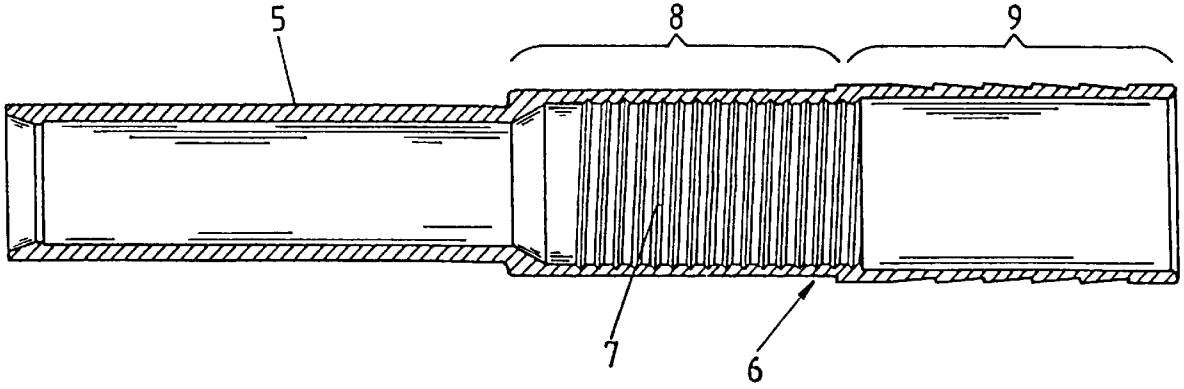
FIG. 6 shows a longitudinal section through the shaft with the handle part.

One end of the jack plug 1 carries tip 2 which is secured by means of the connection part 3 and with the intermediary of an insulating sleeve 4 in the tubular shaft 5. On its side remote of the contact tip 2, this tubular shaft 5 merges into a portion of greater diameter which serves as a handle part 6. As can be seen particularly clearly from FIG. 6, this handle part 6 has a zone 8 which is grooved or knurled 7 on the inside. Zone 8 is followed by another zone 9 having grooves on its outer side. The length of connection part 3 of the contact tip 2 is only approximately half the length of the shaft 5. It is important that the connection part 3 which, if required, is formed in one piece with the contact tip 2 has a bore hole 10 which extends along its entire length reaching into the interior of the contact tip 2 (FIG. 5). A solder and flux, a soldering paste, are advisably introduced in the portion of the bore hole 10 located in the contact tip 2, which is carried out in the fabrication plant and is not shown.

It can be seen from the description above that the jack plug, according to the invention, comprises only three parts, namely, the contact tip 2 with the connection part 3, the insulating sleeve 4, and the shaft 5 with the handle part 6. The shaft 5 and handle part 6 are also constructed in one piece.

Figure 1:
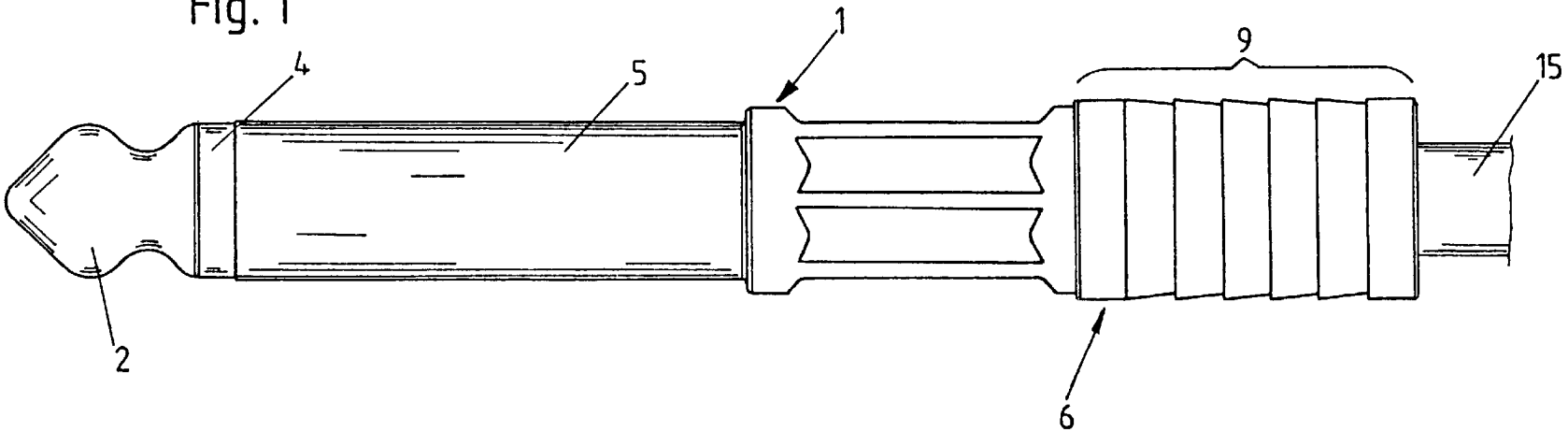
FIG. 1 shows a side view of a jack plug with connected cable.
Figure 2:
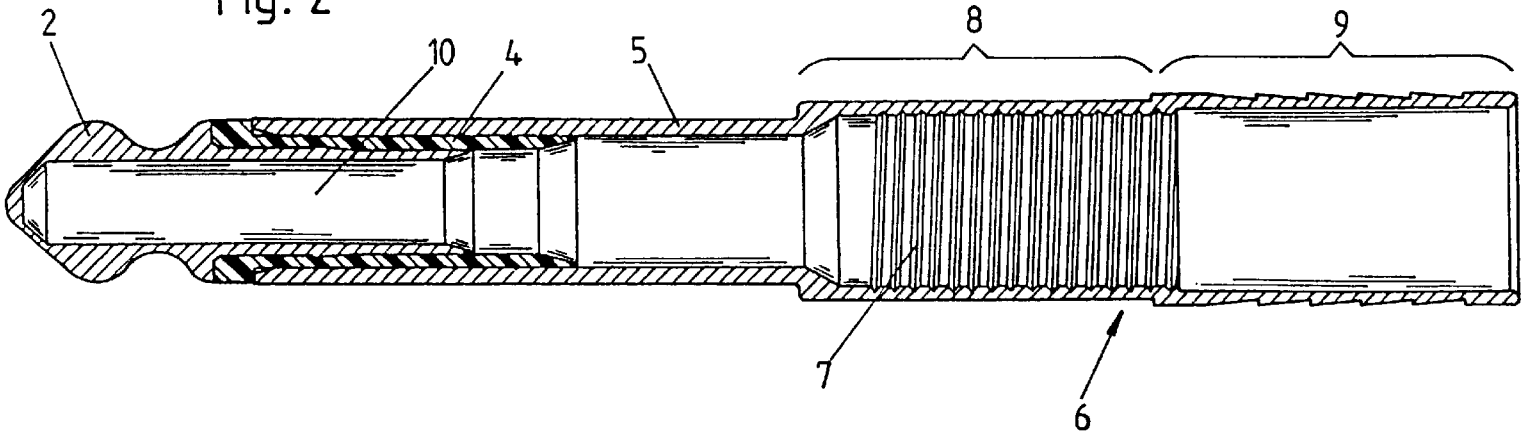
FIG. 2 shows the jack plug according to FIG. 1 in longitudinal section, but without connected cable and without radial squeezing.
Figure 3:
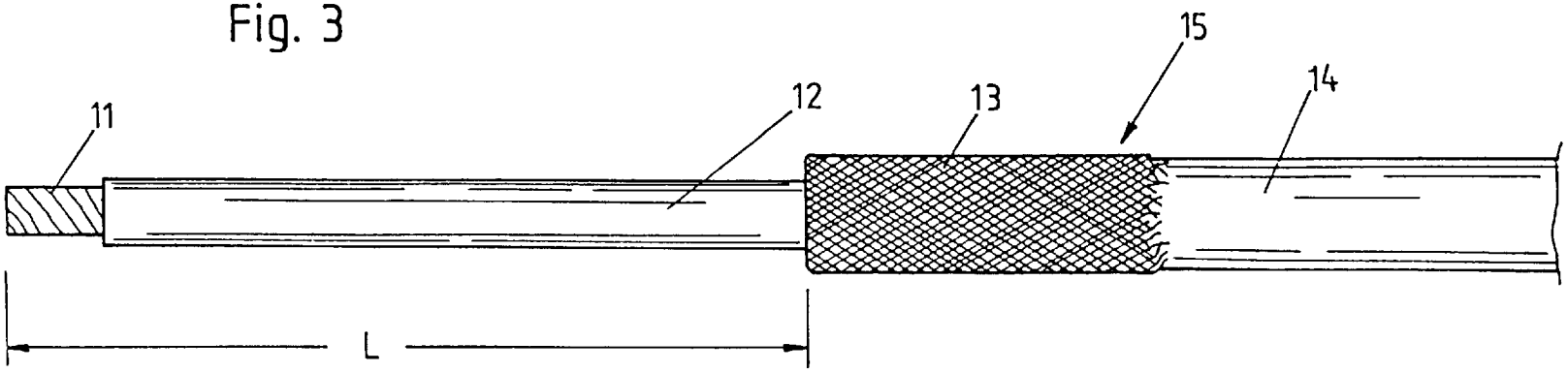
FIG. 3 shows the end of the cable prepared for connection to the jack plug.
Figure 4:
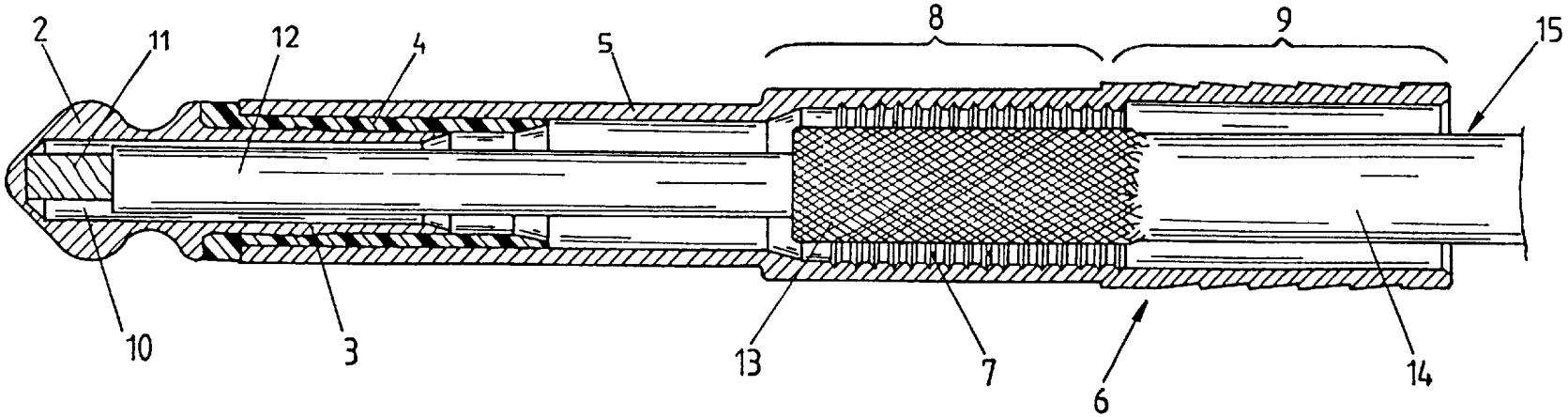
FIG. 4 shows a longitudinal sections through the jack plug as in FIG. 2, but with inserted cable.
Figure 7:
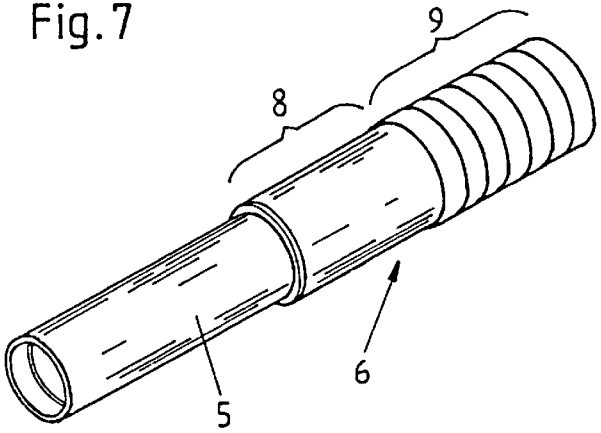
FIG. 7 is an oblique view of the shaft with the handle part.

FIG. 3 shows the end of a coaxial cable 15 which is prepared for the connection to the jack plug according to the invention. The center stranded-wire conductor 11 is enclosed by a first insulating sleeve 12. This insulating sleeve 12 is enclosed by a shielding braid 13 which is, in turn, covered by the insulating jacket 14. The outer insulating jacket 14 is removed, namely, over length L, at the end of the cable to be connected (FIG. 3) and the shielding braid 13 is then folded back so that it contacts the portion of the outer insulating jacket shown in this Figure. The end of the cable which is prepared in this way (FIG. 3) is now introduced into the jack plug (FIG. 4), and the solder paste located in the bore hole 10 of the contact tip 2 is subsequently heated by a suitable device, and the center stranded-wire conductor 11 is accordingly connected with the contact tip 2 through the agency of material. The device mentioned in this connection is a kind of soldering iron which has a corresponding shape of suitable dimensions with respect to the end or front portion of the contact tip 2. Since the bore hole 10 projects far into the contact tip (FIG. 5), the heat required for melting the solder paste is conducted along the shortest path directly to the location where it is needed without damaging the insulation. The soldering iron and contact tip 2 need only be in contact briefly for this purpose. Subsequently, zone 8 is deformed by squeezing together radially (crimping) so that it narrows in diameter over its cross section (FIG. 1), wherein the grooves 7 contact the folded back shielding braid 13 under pressure and the required grounding contact is accordingly provided on the one hand and, on the other hand, the cable is held in a positive engagement and in a frictional engagement and mechanically anchored so that the required pull-relief is provided. This electrical connection by means of crimping and simultaneous mechanical anchoring of the cable keeps mechanical stresses away from the solder location inside the contact tip 2. The zone at the handle part 6 with the external grooves facilitates manipulation and handling of the jack plug.

When a slight tensile force is exerted (toward the right in FIG. 1) on the cable during the crimping of zone 8, the contact tip 2, insulating sleeve 4 and shaft 6 are additionally held together by this slight tensile force.

In the shown embodiment example, the handle part 6 has approximately the same length as the shaft 5. It lies within the scope of the invention to make the handle part 6 shorter, for example, only as long as the zone 8. The deformations of zone 8 which ate achieved by means of crimping or squeezing then serve to facilitate handling and manipulation of the jack plug. If needed or if desired, a sleeve of elastomer material can also be pulled up over the handle part 6. The shaft 5 and handle part 6 are constructed in one piece. This handle part of the jack plug fulfills three functions: as ground contact for the cable shielding 13, as pull-relief for the cable by means of the squeezing or crimping, and it serves simultaneously as a handle and actuating grip. This jack plug has very few parts; assembly and the connection of a cable are very simple. The distance between the connected stranded-wire conductor 11 and the front of the folded over shielding braid 13 is relatively large, so that there is a low risk of short circuiting due to possibly loose shielding wire. The constructional shape is extremely compact.

Figure 8:
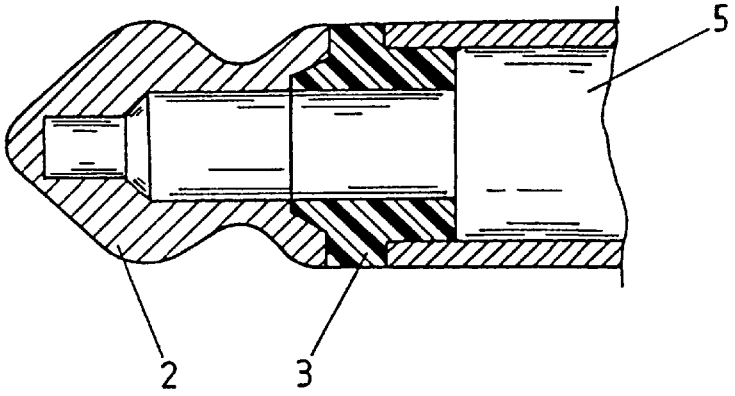
FIG. 8 shows a variant.

In the embodiment example shown in FIG. 5, the contact tip 2 and the connection part 3 are constructed in one piece. It lies within the scope of the invention to construct the connection part 3 as an independent structural component part, as is shown, for example, in FIG. 8. In this case, the connection part 3 is made of insulating material. The individual parts can be held together in the following manner: After the end of the wire is soldered with the contact tip 2 in the indicated manner, tension is exerted on the wire to be connected and zone 8 is then crimped. In this way, the wire piece between zone 8 and the contact tip 2 fulfills two functions: this portion serves as a conductor element on the one hand and as a connection element for the contact tip 2, connection part 3 and handle part 6 on the other hand.

Figure 9:
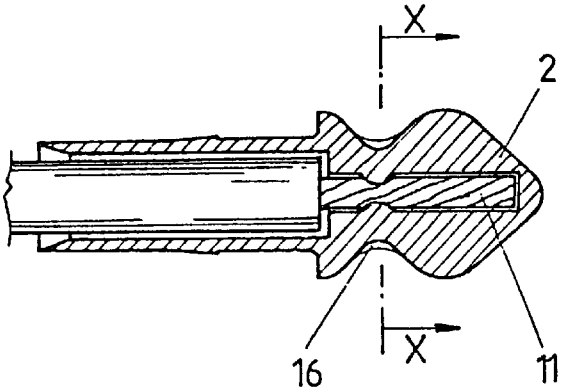
FIG. 9 shows a cross section through a contact tip and the conductor fixed by a positive engagement.
Figure 10:
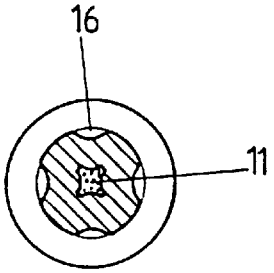
FIG. 10 shows a cross section according to line X—X in FIG. 9.

A further possibility for the connection of the stranded-wire conductor 11 and the contact tip 2 consists in that the constricted area directly following the contact tip 2 is provided with radial crimps 16 which are advantageously arranged in a punctiform manner along the circumference of this constricted area. This is shown in FIGS. 9 and 10 in longitudinal section and in cross section.

While the foregoing description and drawings represent the preferred embodiments of the present invention, it will be obvious to those skilled in the art that various changes and modifications may be made therein without departing from the true spirit and scope of the present invention.

What is claimed is:

1. A jack plug comprising:

a closed-ended contact tip provided at a free end;

a connection part following and coupled to said contact tip; and a tubular shaft of the jack plug for receiving said connection part;

said contact tip being electrically insulated from said shaft;

said shaft having at a side remote of the contact tip a handle part through which a connecting cable runs;

said connection part having a bore hole which penetrates it over its entire length and extends into the interior of the contact tip;

said cable having a conductor therein being secured in an interior of the contact tip, said conductor extending beyond the shaft and into the contact tip, wherein when said contact tip is fully assembled with said tubular shaft, heat can be applied to said contact tip to melt solder and form a permanent electrical connection between said contact tip and said conductor.

2. The jack plug of claim 1, wherein said connection part is formed in one piece with the contact tip.

3. The jack plug according to claim 1, wherein the portion of the bore hole located in the contact tip is filled with a solder.

4. The jack plug according to claim 1, wherein the axial length of the connection part penetrated by the bore hole corresponds to approximately half the length of the tubular shaft.

5. The jack plug according to claim 1, wherein the handle part is formed by a portion which follows the tubular shaft and is formed in one piece with the shaft and is widened in diameter compared with the shaft.

6. The jack plug according to claim 4, wherein at least one zone of the handle part is knurled or grooved on its inner side and said zone is narrowed in diameter by radial squeezing after insertion of the cable to be connected.

7. The jack plug according to claim 4, wherein the handle part has a zone which is grooved or knurled at its outer side.

8. The jack plug according to claim 5, wherein the zone of the handle part provided for radial squeezing directly adjoins the tubular shaft.

9. The jack plug according to claim 1, wherein the constricted area directly adjoining the contact tip has radial squeezed portions.

10. The jack plug according to claim 9, wherein the radial squeezed portions are punctiform portions for forming a positive engagement.

* * * * *